US005979751A

United States Patent [19]

Maddox

[11] Patent Number: 5,979,751

[45] Date of Patent: Nov. 9, 1999

[54] ROTATING MAILBOX SYSTEM

[76] Inventor: Joseph Y. Maddox, 411 Kildare Dr., Shelby, N.C. 28152

[21] Appl. No.: 09/150,612

[22] Filed: Sep. 10, 1998

[51] Int. Cl.[6] ..... B65G 11/04

[52] U.S. Cl. ..... 232/52; 232/17; 232/45; 232/34; 340/569

[58] Field of Search ..... 232/52, 34, 35, 232/36, 37, 17, 45, 43.1, 47, 61; 340/569

[56] References Cited

U.S. PATENT DOCUMENTS

| | | | |
|---|---|---|---|
| 104,816 | 6/1870 | Baranger | 232/61 |
| 120,578 | 11/1871 | Farrington | 232/52 |
| 378,955 | 3/1888 | Dubey | 232/61 |
| 441,898 | 12/1890 | Regester | 232/52 |
| 990,925 | 5/1911 | Sultz | 232/52 |
| 1,227,934 | 5/1917 | Riegg . | |
| 3,519,198 | 7/1970 | Benoliel | 232/52 X |
| 4,651,135 | 3/1987 | Duhaime et al. | 232/34 X |
| 4,793,551 | 12/1988 | Baylor | 232/17 |
| 4,993,626 | 2/1991 | Berry | 232/17 |
| 5,125,570 | 6/1992 | Jones | 232/24 |
| 5,148,974 | 9/1992 | Clapper | 232/17 |
| 5,239,305 | 8/1993 | Murphy et al. | 232/35 X |
| 5,247,282 | 9/1993 | Marshall | 232/35 X |
| 5,335,848 | 8/1994 | Schreiber | 232/34 |
| 5,664,728 | 9/1997 | Jones | 232/36 |
| 5,695,113 | 12/1997 | Rau et al. | 232/34 |

*Primary Examiner*—Terry Lee Melius
*Assistant Examiner*—William L. Miller

[57] ABSTRACT

A mailbox system is provided including a housing including a chamber with a door allowing access to the chamber; and a rotatable guide assembly including a shaft rotatably mounted in the housing and a plurality of plates extending radially from the shaft, wherein the guide assembly is adapted to rotate upon the movement of the door for transferring mail into the chamber.

22 Claims, 3 Drawing Sheets

FIG 1
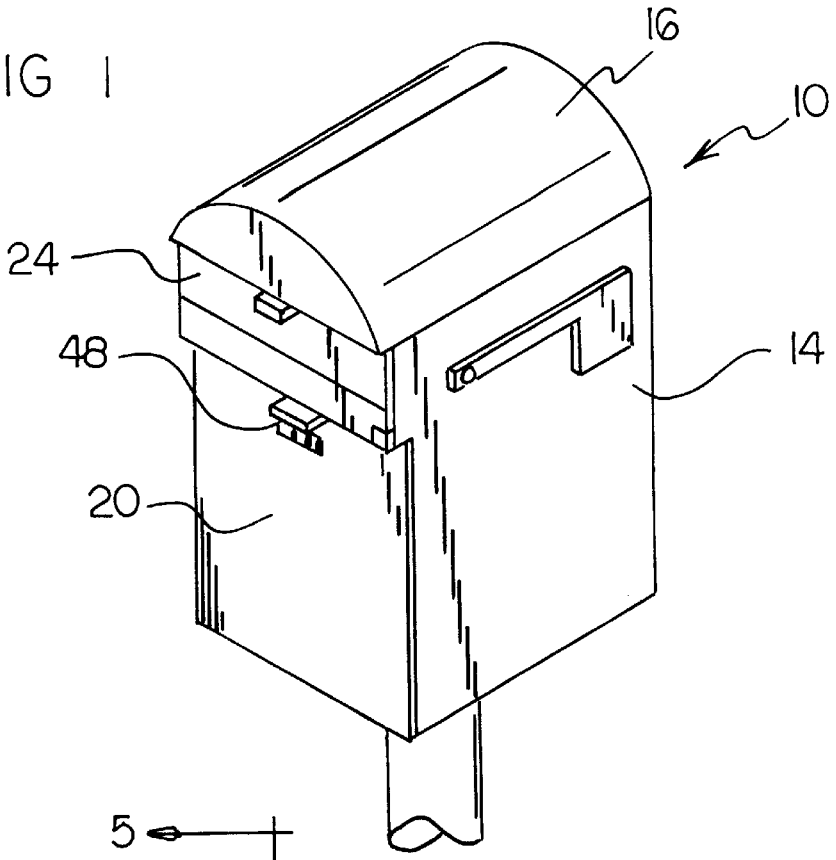
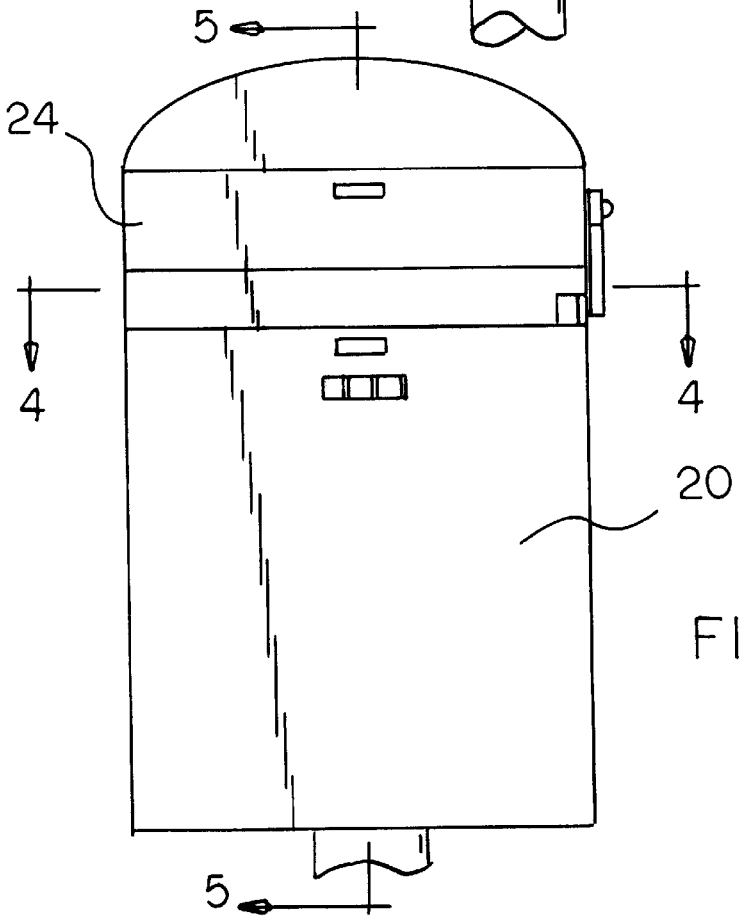
FIG 2

ROTATING MAILBOX SYSTEM

BACKGROUND OF THE INVENTION

1. Field of the Invention

The present invention relates to a rotating mailbox system and more particularly pertains to maximizing the security and convenience of delivered mail.

2. Description of the Prior Art

The use of mailboxes of various designs and configurations is known in the prior art. More specifically, mailboxes of various designs and configurations heretofore devised and utilized for the purpose of increasing either the security or the convenience of mailboxes through various methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,993,626 to Berry disclosed a Security Mailbox. U.S. Pat. No. 4,793,551 to Baylor discloses a Storage Mail Box. U.S. Pat. No. 5,023,595 to Bennett discloses a Mail Arrival Signal System. U.S. Pat. No. 5,148,974 to Clapper discloses a Security Mail Box With Improved Anti-Tamper Means. U.S. Pat. No. 1,227,934 to Riegg discloses a Mail Chute and Receptacle. Lastly, U.S. Pat. No. 3,070,234 to Deitchman discloses a Toy Mail Classification Rack.

While these devices fulfill their respective, particular objectives and requirements, the aformentioned patents do not describe a rotating mailbox system that allows security and convenience for the recipient of delivered mail.

In this respect, the rotating mailbox system according to the present invention substantially departs from the conventional concepts and designs of the prior art, and in doing so provides an apparatus primarily developed for the purpose of for maximizing the security and convenience of delivered mail.

Therefore, it can be appreciated that there exists a continuing need for a new and improved rotating mailbox system which can be used for maximizing the security and convenience of delivered mail. In this regard, the present invention substantially fulfills this need.

SUMMARY OF THE INVENTION

In view of the foregoing disadvantages inherent in the known types of mailboxes of various designs and configuration now present in the prior art, the present invention provides an improved rotating mailbox system. As such, the general purpose of the present invention, which will be described subsequently in greater detail, is to provide a new and improved rotating mailbox system and method which has all the advantages of the prior art and none of the disadvantages.

To attain this, the present invention essentially comprises a new and improved rotating mailbox system for maximizing the security and convenience of delivered mail comprising, in combination a generally rectilinear housing with a domed top and a lower chamber for securely holding delivered mail. A front lower door is provided lower door and is operable by the user and with a combination lock to preclude unauthorized entrance. The housing also has an upper chamber for depositing mail therethrough with a front upper door operable by a postman. A rotatable guide assembly is provided formed of a shaft rotatably mounted in the housing with a ratchet gear at one of the ends of the shaft.

The guide assembly also includes four plates radially secured to the shaft. The plates are selectively movable in ninety degree increments from a first horizontal position adjacent to the second door to receive letters, to a second upper vertical position to preclude access to the lower chamber through the second door, to a third horizontal position remote from the second door, and to a fourth lower vertical position for dropping delivered mail to the second chamber. At least one push rod is provided which is positionable between the second door and the rotating ratchet gear with a spring urging the rod toward the second door whereby opening the door will move the rod away from the ratchet gears. Closing of the second door will reciprocate the rod inwardly against the ratchet gear to turn the plates ninety degrees so that a single opening and closing of the door will move deposited mail to a position remote from the second door while a second opening and closing of the door will allow the dropping of the mail to the second or the second chamber. A first sensor is provided in the bottom of the housing with a plate thereabove for receiving deposited mail and generating a signal for alerting the user of the presence of delivered mail. Supplemental components are provided above the upper chamber including a second sensor and a light to illuminate when the second door is opened and a lamp connected to the first sensor on the side of the housing remote from the doors to inform the user of the presence of delivered mail when the signal is received.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart form the spirit and scope of the present invention.

It is therefore an object of the present invention to provide a new and improved rotating mailbox system which has all of the advantages of the prior art mailboxes for various designs and configurations and none of the disadvantages.

It is another object of the present invention to provide a new and improved rotating mailbox system which may be easily and efficiently manufactured and marketed. It is further object of the present invention to provide a new and improved rotating mailbox system which is of durable and reliable constructions.

An even further object of the present invention is to provide a new and improved rotating mailbox system which is susceptible of a low cost of manufacture with regard to both materials and labor, and which accordingly is then susceptible of low prices of sale to the consuming public, thereby making such rotating mailbox system economically available to the buying public.

Even still another object of the present invention is to provide a rotating mailbox system for maximizing the security and convenience of delivered mail.

Lastly, it is an object of the present invention to provide a mailbox system including a housing having a chamber with a door allowing access to the chamber; and a rotatable guide assembly including a shaft rotatably mounted in the housing and a plurality of plates extending radially from the shaft, wherein the guide assembly is adapted to rotate upon the movement of the door for transferring mail into the chamber.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof.

FIG. 1 is a perspective view of the preferred embodiment of the rotating mailbox system constructed in accordance with the principles of the present invention.

FIG. 2 is a front elevational view of the mailbox shown in FIG. 1.

The same reference numerals refer to the same parts through the various Figures.

DESCRIPTION OF THE PREFERRED EMBODIMENT

Figure 3:
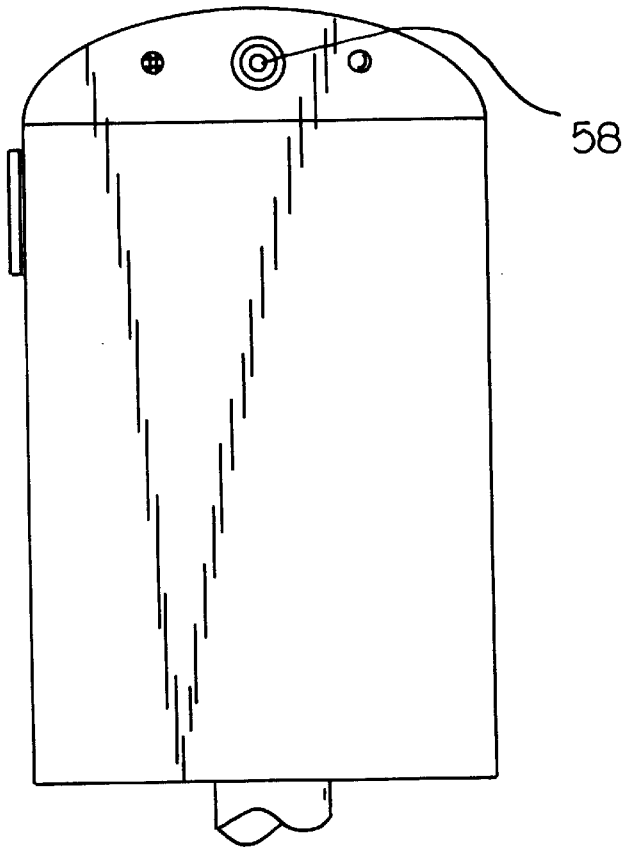
FIG. 3 is a rear elevational view of the mailboxes shown in FIGS. 1 and 2.
Figure 4:
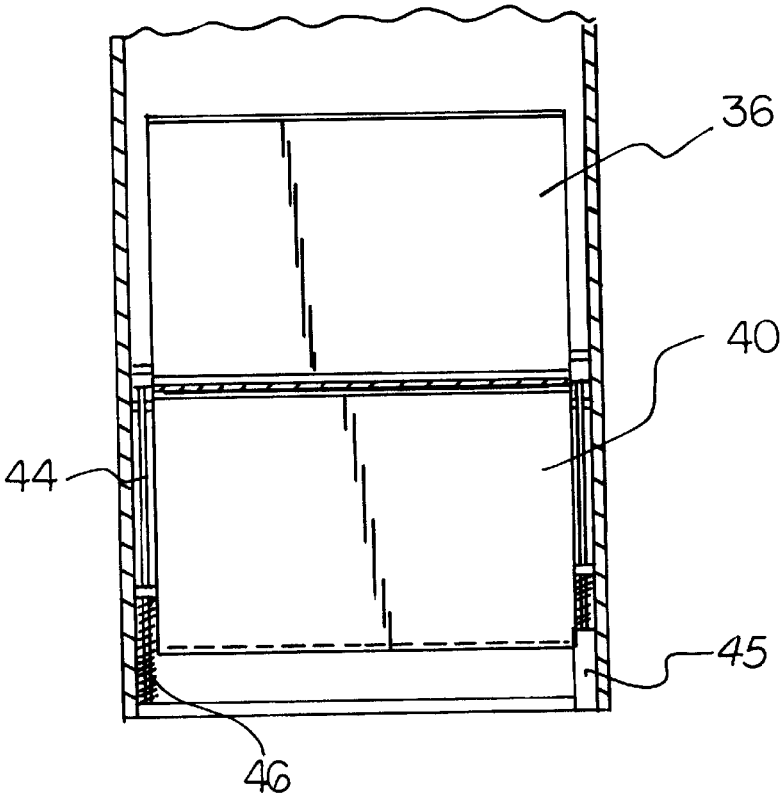
FIG. 4 is a cross-sectional view taken along line 4—4 of FIG. 2.

With reference now to the drawings, and in particular to FIG. 1 thereof, the preferred embodiment of the new and improved rotating mailbox system embodying the principles and concepts of the present invention and generally designated by the reference numeral 10 will be described.

The present invention, the rotating mailbox system 10 is comprised of a plurality of components. Such components are individually configured and correlated with respect to each other so as to attain the desired objective.

More specifically, the system 10 includes a generally rectilinear housing 14 with a domed top 16. The system also includes a lower chamber 18 for securely holding delivered mail. The lower chamber is equipped with a front lower door 20 operable by the user and with a combination lock 48 to preclude unauthorized entrance. The housing also has an upper chamber 22 for depositing mail therethrough with a front upper door 24 which is operable by a postman or other user.

Also provided is a rotatable guide assembly 28 formed of a shaft 30 rotatably mounted in the housing with ratchet gears 32 at the ends of the shaft. During use, the ratchet gears rotate the shaft coincidentally therewith when rotated in a first direction and further rotate independently of the shaft when rotated in a second direction. The guide assembly also includes four planar plates 34, 36, 38, 40, radially secured to the shaft and angularly offset by 90 degrees. By a means that will soon be set forth, the plates are selectively movable in ninety degree increments from a first horizontal position adjacent to the second door to receive letters, to a second upper vertical position to preclude access to the lower chamber through the second door, to a third horizontal position remote from the second door, and to a fourth lower vertical position for dropping delivered mail to the second chamber.

Also provided is a pair of horizontally oriented push rods 44 with a plurality of gear teeth formed thereon to define a rack. One of the push rods is positioned between the second door and further in engagement with one of the rotating ratchet gears thereby affording a rack and pinion-type mechanism. A second one of the push rods is connected to a manual button 45 and also affords a rack and pinion-type mechanism. A guide slidably receives each of the rods to maintain the same horizontally oriented. Springs 46 are each situated about each of the rods and coupled between an end of the rod and a stop on the rod. By this interconnection, each of the rods is urged toward a front of the housing.

Figure 5:
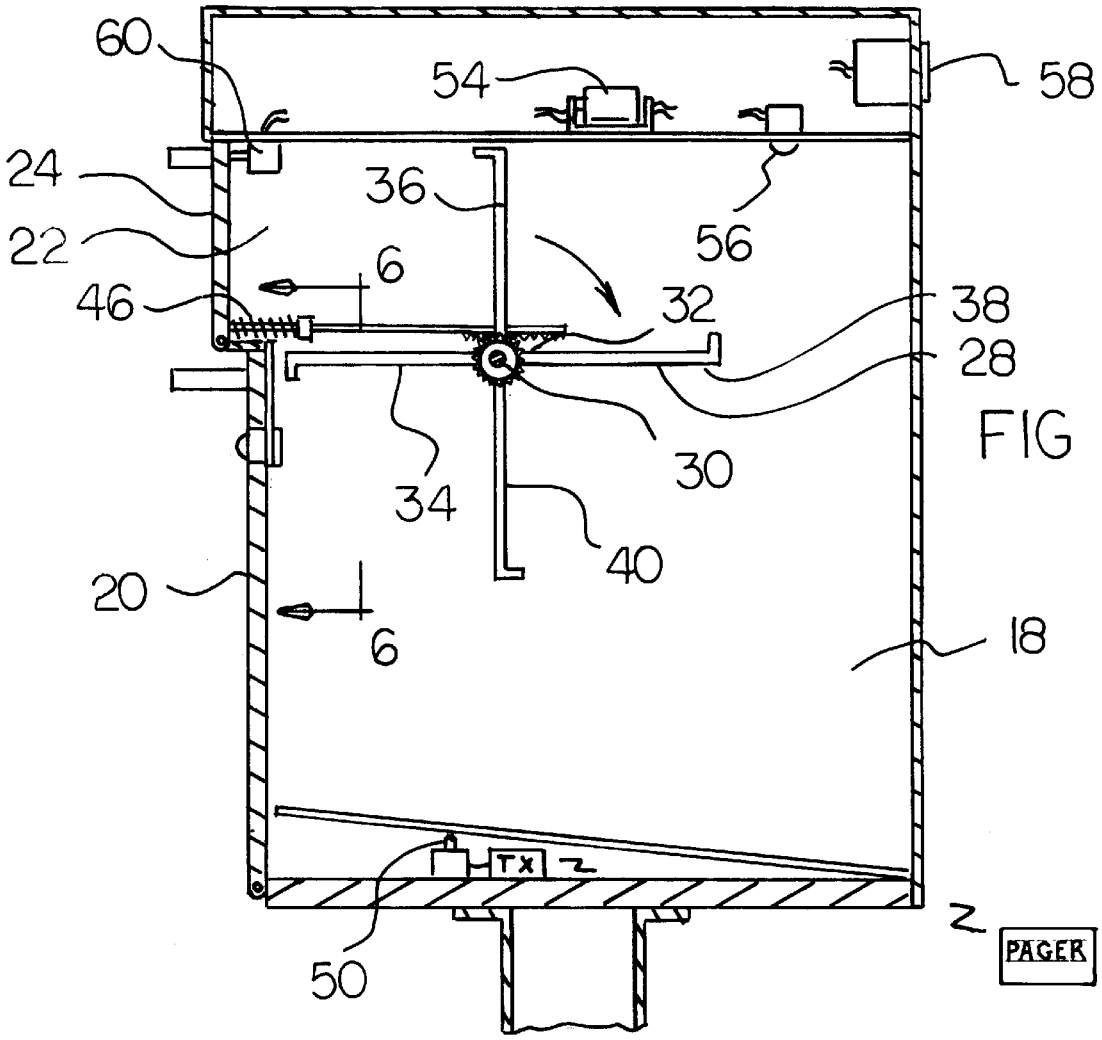
FIG. 5 is a cross-sectional view taken along line 6—6 of FIG. 5.
Figure 6:
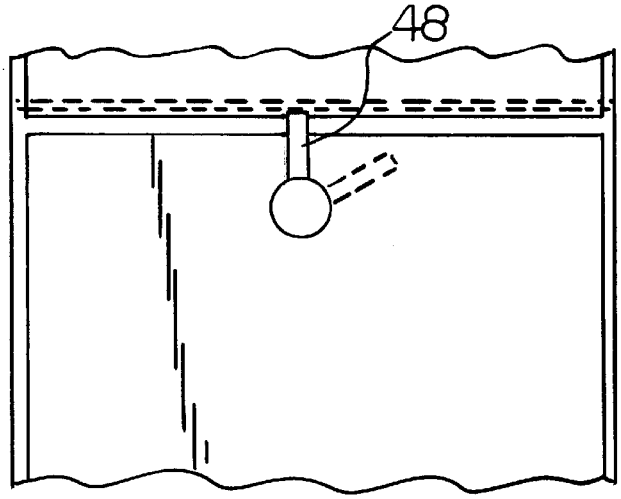
FIG. 6 is a cross-sectional view taken along line 6—6 of FIG. 5.

In use, opening the second door will move one rod away from the ratchet gears, thereby imparting no motion on the plates. Upon closing of the second door, the rods move inwardly against the ratchet gears to turn the plates ninety degrees so that a single opening and closing of the door will move deposited mail to a position remote from the second door. A second opening and closing of the door will allow the dropping of the mail to the second or the second chamber. Note FIG. 5. It should be noted that similar action is effected upon the depression of the manual button 45.

Also provided is a first sensor 50 in the bottom of the housing with a plate thereabove for receiving deposited mail. When mail accumulates a predetermined weight, a button of the first sensor is depressed, thereby generating a signal for alerting the user of the presence of delivered mail. Connected to the first sensor is a transmitter adapted to transmit the signal view free space upon the receipt thereof. Such free space signal may be received via a page, remote speaker, or a remote lamp for alerting a remote user that mail has accumulated. Further, the first sensor may be connected to an indicator lamp 58 on the side of the housing remote from the doors. Upon the receipt of the signal, the indicator lamp serves to inform a proximal user of the presence of delivered mail. Lastly provided are supplemental components above the upper chamber. Such supplemental components include a battery 54 for powering the various electrical devices of the present invention. Further, a second sensor 60 is mounted adjacent the second door or the first door and connected to a light 56. In use, the light illuminates the lower chamber upon the opening of the door abutting the sensor 60.

As described hereinabove, the system of the present invention is a mailbox that contains a gear driven, rotating, four tray system to deposit mail into a secure location within the box, protecting the mail from theft. As the mail is delivered and the upper door is opened, a push rod is activated to cause the mail tray to rotate in a clockwise motion. Eventually, with multiple mail deliveries, the tray would reach an upside down position, and the mail falls to a storage unit in the bottom of the mailbox. A manual release button is operated to rotate the trays to receive that day's mail. A homeowner can then unlock the bottom compartment to retrieve the mail.

Other features include a rain protective lip, a flat for outgoing mail, and a name and number plate. The appealing features of the system of the present invention are its convenience, security, organizational qualities, and communication features.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new and improved rotating mailbox system for maximizing the security and convenience of delivered mail comprising:

a generally rectilinear housing with a domed top and a lower chamber for securely holding delivered mail with a front lower door operable by a user and with a combination lock to preclude unauthorized entrance, the housing also having an upper chamber for depositing mail therethrough with a front upper door operable by a postman;

a rotatable guide assembly formed of a shaft rotatably mounted in the housing with ratchet gears at ends of the shaft, the guide assembly also including four plates radially secured to the shaft, the plates selectively movable in ninety degree increments from a first horizontal position adjacent to the front upper door to receive letters, to a second upper vertical position to preclude access to the lower chamber through the front upper door, to a third horizontal position remote from the front upper door, and to a fourth lower vertical position for dropping delivered mail to the lower chamber;

at least one push rod positionable between the front upper door and the ratchet gears with a spring urging the rod toward the front upper door whereby opening the front upper door will move the rod away from the ratchet gears whereby closing of the front upper door will reciprocate the rod inwardly against the ratchet gears to turn the plates ninety degrees so that a single opening and closing of the front upper door is adapted to move deposited mail to a position remote from the front upper door while a second opening and closing of the front upper door is adapted to allow the dropping of the mail to the lower chamber;

a first sensor in the lower chamber of the housing with a plate thereabove for receiving deposited mail and generating a signal for alerting the user for the presence of delivered mail; and supplemental components above the upper chamber including a battery for powering the various supplemental components including a second sensor and a light to illuminate when the front upper door is opened and a lamp connected to the first sensor on a side of the housing remote form the upper and lower doors to inform the user of the presence of delivered mail when the signal is received.

2. A mailbox system comprising:

a housing including a chamber with a door allowing access to the chamber;

a rotable guide assembly formed of a shaft rotatably mounted in the housing and a plurality of plates extending radially from the shaft, wherein the guide assembly is adapted to rotate upon the movement of the door for transferring mail into the chamber; and at least one rod connected to the guide assembly for rotating the guide assembly, wherein the rod has gear teeth formed thereon for engaging a gear on the shaft of the guide assembly.

3. A mailbox system as set forth in claim 2 wherein a second door is mounted on the housing for allowing access to the chamber to authorized persons only.

4. A mailbox system as set forth in claim 3 wherein a sensor is mounted adjacent one of the doors for illuminating the chamber with a lamp upon the opening thereof.

5. A mailbox system as set forth in claim 2 wherein a sensor is positioned within the chamber with a panel thereover for transmitting a signal upon the accumulation of a predetermined amount of mail within the chamber.

6. A mailbox system as set forth in claim 5 wherein the sensor is connected to a transmitter for transmitting the signal via free space and further including a remote indicator for providing an indication to a remote user upon the receipt of the signal via free space.

7. A mailbox system as set forth in claim 5 wherein the sensor is connected to a lamp mounted on the housing for illuminating the housing upon the receipt of the signal.

8. A mailbox system as set forth in claim 2 wherein the gear on the shaft of the guide assembly is a ratchet gear.

9. A mailbox system as set forth in claim 2 wherein the rod is connected to the door.

10. A mailbox system comprising:

a housing including a chamber with a door allowing access to the chamber;

a rotatable guide assembly formed of a shaft rotatably mounted in the housing and a plurality of plates extending radially form the shaft, wherein the guide assembly is adapted to rotate upon the movement of the door for transferring mail into the chamber; and at least one rod connected to the guide assembly for rotating the guide assembly;

wherein the rod is spring-loaded.

11. A mailbox system as set forth in claim 10 wherein a second door is mounted on the housing for allowing access to the chamber to authorized persons only.

12. A mailbox system as set forth in claim 11 including a sensor connected to a transmitter for transmitting a signal via free space and further including a remote indicator for providing an indication to a remote user upon the receipt of the signal via free space.

13. A mailbox system as set forth in claim 11 including a sensor connected to a lamp mounted on the housing for illuminating the housing upon the receipt of a signal.

14. A mailbox system as set forth in claim 10 wherein the rod has gear teeth formed thereon for engaging a gear on the shaft of the guide assembly.

15. A mailbox system as set forth in claim 14 wherein the gear on the shaft of the guide assembly is a ratchet gear.

16. A mailbox system as set forth in claim 10 wherein the rod is connected to the door.

17. A mailbox system comprising:

a housing including a chamber with a door allowing access to the chamber; and a rotatable guide assembly formed of a shaft rotatably mounted in the housing and a plurality of plates extending radially from the shaft, wherein the guide assembly is adapted to rotate upon the movement of the door for transferring mail into the chamber;

said shaft of the guide assembly including a gear mechanism at an end thereof for cooperating with at least one spring-loaded rod for rotating the guide assembly in ninety degree increments.

18. A mailbox system as set forth in claim 17 wherein the rod has gear teeth formed thereon for engaging the gear mechanism on the shaft of the guide assembly.

19. A mailbox system as set forth in claim 17 wherein a second door is mounted on the housing for allowing access to the chamber to authorized persons only.

20. A mailbox system as set forth in claim 17 including a sensor connected to a transmitter for transmitting a signal via free space and further including a remote indicator for providing an indication to a remote user upon the receipt of the signal via free space.

21. A mailbox system as set forth in claim 17 including a sensor connected to a lamp mounted on the housing for illuminating the housing upon the receipt of a signal.

22. A mailbox system as set forth in claim 17 wherein the gear mechanism on the shaft of the guide assembly is a ratchet gear.

* * * * *